US008272714B2

(12) United States Patent
Blackman et al.

(10) Patent No.: US 8,272,714 B2
(45) Date of Patent: Sep. 25, 2012

(54) PRINTING SPITTOON

(75) Inventors: Jeffrey R. Blackman, Vancouver, WA (US); Mark D. Groenenboom, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 158 days.

(21) Appl. No.: 12/436,670

(22) Filed: May 6, 2009

(65) Prior Publication Data

US 2010/0283816 A1 Nov. 11, 2010

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS

| | | | | |
|---|---|---|---|---|
| 3,879,785 | A | 4/1975 | Roth et al. | |
| 5,896,145 | A | 4/1999 | Osborne et al. | |
| 6,082,848 | A | 7/2000 | Taylor | |
| 6,247,783 | B1 | 6/2001 | Shibata et al. | |
| 6,328,442 | B1 * | 12/2001 | Brinkly | 347/104 |
| 6,692,100 | B2 | 2/2004 | Steinfield et al. | |
| 6,742,864 | B2 | 6/2004 | Therien et al. | |
| RE38,978 | E | 2/2006 | Nakajima et al. | |
| 7,267,422 | B2 * | 9/2007 | Brookmire et al. | 347/22 |
| 7,311,376 | B2 * | 12/2007 | Gast et al. | 347/33 |
| 2004/0257397 | A1 | 12/2004 | Gomez et al. | |
| 2005/0270327 | A1 * | 12/2005 | Brookmire et al. | 347/35 |
| 2006/0209152 | A1 * | 9/2006 | Baringa et al. | 347/104 |
| 2008/0117253 | A1 | 5/2008 | Yearout et al. | |
| 2008/0238993 | A1 | 10/2008 | Gomez et al. | |

* cited by examiner

*Primary Examiner* — Matthew Luu
*Assistant Examiner* — Alejandro Valencia

(57) ABSTRACT

A print spittoon is removably mounted in a slot of a print support to periodically receive drops of liquid spit from a printhead. Among other features, the spittoon includes a portion of an absorbent sheet provided a location recessed from a surface of the print support.

12 Claims, 6 Drawing Sheets

PRINTING SPITTOON

BACKGROUND

Drum-based printing systems frequently offer an effective solution to speed and reliability requirements imposed by mass printing applications. Accordingly, during recent years these printing systems have undergone a trend of continually increasing popularity and demand.

Many drum-based printing systems incorporate printheads designed to eject tiny droplets of liquid ink. In such systems, print media are typically loaded onto a drum and rotated past the printheads. As the print media rotates by the printheads, the printheads deposit the ink droplets on the print media in a specific pattern to form a desired image on the print media.

To obtain and maintain good printed image quality, many printheads require periodic cleaning to flush drying ink from the printhead nozzles. This periodic cleaning is known as decap spitting or decapping.

Decap spitting operations are generally performed by ejecting a number of ink droplets through the nozzles of the printheads into a special receptacle, known as a spittoon. The decap spitting operations in the printheads help maintain acceptable quality in printed products by ensuring that the first few drops ejected from each nozzle have an adequate trajectory and satisfactory optical density.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

Throughout the drawings, identical reference numbers designate similar, but not necessarily identical, elements.

DETAILED DESCRIPTION

Figure 1:
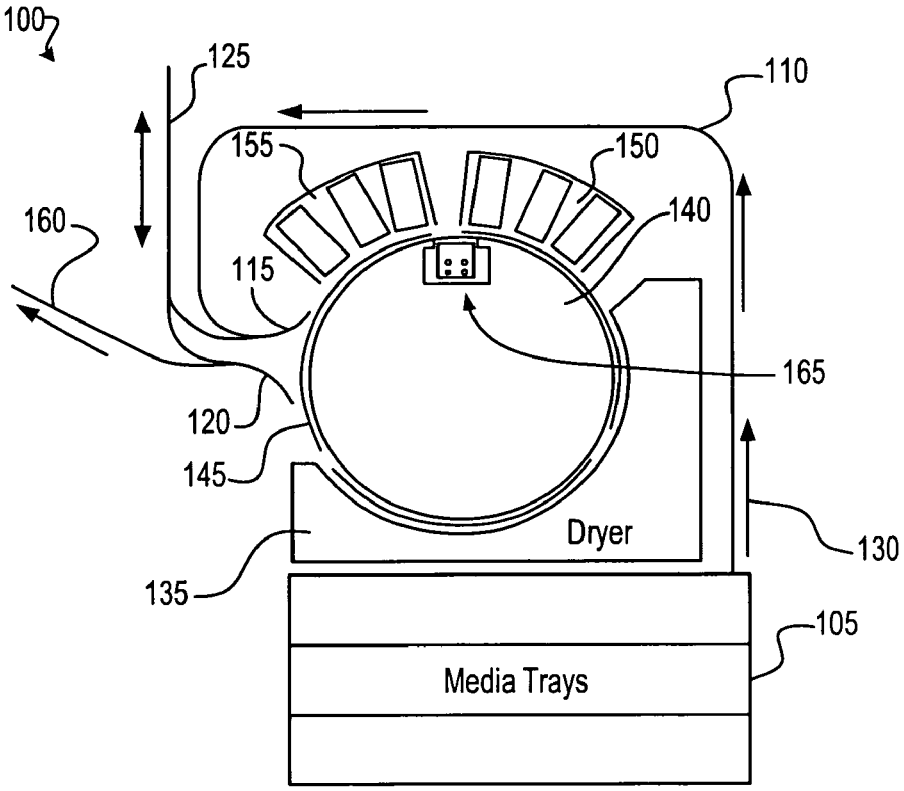
FIG. 1 is side view schematically illustrating a printing system, according to an embodiment of the present disclosure.

In the following Detailed Description, reference is made to the accompanying drawings, which form a part hereof, and in which is shown by way of illustration specific embodiments in which the present invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

As indicated above, in the case of printing devices incorporating liquid ink printheads and a cyclic multi-page transport drum for print media, it is desirable to maximize printhead health and printing quality by periodically cleansing the printhead nozzles by spitting or decapping. However, it is also desirable to maintain maximum printing throughput. Consequently, it may be undesirable to interrupt printing by moving the printheads to a position off the drum in order to perform the necessary decap spitting. Doing so may considerably reduce throughput and affect image quality due to decreased precision in carriage positioning.

To address the issue of maximizing printhead health and print quality in drum-based printing systems without significantly reducing throughput, the present disclosure describes exemplary systems and devices relating to a replaceable printer spittoon. The replaceable printer spittoon is disposed within a recess of a print drum or other print support, and includes a system of rollers configured to provide a clean, absorbent material to the printhead for decap spitting.

As used in the present specification and in the appended claims, in some embodiments, the terms "drum," "printing drum," and corresponding derivatives refer to a cylindrical cyclical transport apparatus configured to rotate print media through different phases of a printing process. In at least some embodiments, the drum may be large enough to accommodate multiple sheets of a print medium simultaneously.

As used in the present specification and in the appended claims, in some embodiments, the term "printhead" refers to a device configured to eject droplets of liquid from a reservoir through at least one nozzle or orifice onto a medium. In some embodiments, the ejected liquid comprises ink while in other embodiments, the ejected liquid comprises substances other than ink. In some embodiments, the printhead is used for printing ink or other substances, while in other embodiments, the printhead is used for dispensing or other non-printing applications. In one non-limiting example, the term printhead includes inkjet printheads such as, but not limited to, piezoelectric, thermal, on-axis and off-axis inkjet printheads.

As used in the present specification and in the appended claims, in some embodiments, the terms "spit," "spit operations," "decap" or "decap operations" refer to the process of ejecting a number of droplets of ink or other liquids from a printhead to flush drying ink (or other liquids) from, or otherwise service or test printhead nozzles.

As used in the present specification and in the appended claims, in some embodiments, the term "spittoon" refers to any receptacle configured to collect droplets of ink or other liquids ejected from a printhead, such as during spitting or decapping operations.

As will be appreciated by those skilled in the art, a wide variety of different print media may be used with the spitting printhead as part of a dispensing system, printer or printing system described herein. Such print media may include, but are not limited to; paper, paper-based print media, cardstock, vinyl, linen-based print media, or other media adapted to receive non-ink liquids.

FIG. 1 is a side view diagram that schematically illustrates a drum-based inkjet printing system 100, according to one embodiment of the present disclosure. At the center of the system 100 is a rotating cylindrical drum 140. The drum 140 is configured to receive print media 145 and rotate the media 145 through various phases of the printing process. In this particular embodiment, up to three sheets of media 145 are loaded in portrait orientation to the drum periphery by means of a partial vacuum created in the interior of the drum 140.

In one aspect, the partial vacuum holds the print media 145 to the periphery of the drum 140 throughout printing and drying. Upon completion of the printing and drying processes, the print media 145 is then unloaded from the drum 140 using "cat scratchers," or small teeth that fit into grooves on the drum 140 and lift the page off of the drum 140.

In one aspect, print media 145 is fed to drum 140 through an extended media path 130 in which sheets of print media 145 stored in media trays 105 are retrieved and transported to the drum 140 where they are deskewed and staged for drum mounting. In some embodiments, two or more different sheets of the print medium 145 are mounted on the drum 140 in a single revolution. In other embodiments, one sheet of print medium 145 is mounted on the drum 140 for each revolution of the drum 140

In another aspect, the sheets of print media 145 mounted on the drum 140 are rotated underneath an overhanging array of inkjet print heads 150, 155 for ink application. The inkjet printheads 150, 155 deposit liquid ink droplets on the print media 145 selectively to create images and/or text on the print media 145. In some embodiments, the array of inkjet printheads 150, 155 span the width of print media 145. In other embodiments, the inkjet printheads 150, 155 scan or move across the face of the media 145 to deposit the ink droplets.

In one embodiment, a replaceable printhead spittoon 165 is disposed within a slot or recess in the drum 140. The spittoon 165 includes an absorbent material configured to absorb droplets of liquid ink ejected by the inkjet printheads 150, 155 during decap spitting operations. The spittoon 165 is configured to provide a portion of clean, absorbent material in a recessed position that is in alignment to the printheads 150, 155 as the portion of the outer periphery of the drum 140 bearing the spittoon 165 is rotated to a position underneath the inkjet printheads 150, 155.

Different factors affect how often spitting operations are performed by the printheads 150, 155. In some embodiments, the printheads 150, 155 spit liquid ink on the spittoon 165 as little as once per print job. In other embodiments, spitting operations are performed by the printheads 150, 155 a plurality of times during a print job. Often factors such as print quality, page content, ink usage, number of pages, and other factors, are used to determine the frequency of spitting operations by the printheads 150, 155.

In some embodiments, the replaceable printhead spittoon 165 includes a rolled sheet of the absorbent material onto which the printheads 150, 155 spit. The spittoon 165 is then configured to manipulate the sheet of absorbent material along a spit roller such that material soiled by liquid ink from printhead spitting operations is advanced to a collection roller, as will be described in more detail in later figures. In this way, clean, absorbent material is provided in alignment with the printheads 150, 155 to receive liquid ink from spitting operations.

Moreover, in some embodiments, as the drum 140 continues rotating, the sheets of media 145 pass through a dryer 135. In one non-limiting example, the dryer uses hot air convection to dry the wet print media 145. If the sheet of media 145 has finished the printing process, it is then unloaded from the drum 140. For a one-sided sheet or the second side of a duplex sheet, offloading is made to an output media path 160 and onto either a tray or finisher device. For the first side of a duplex sheet, offloading is to a one-sheet turnaround path 125 that flips the sheet and stages it for remounting to the drum 140. In some instances, different sheets of media 145 will remain on the drum 140 for varying amounts of time before being unloaded from the drum 140, depending on the content of the pages to be printed.

Furthermore, the amount of time a sheet of print media 145 remains on the drum 140 may be affected by printhead spitting. It may be desirable in some embodiments to perform a decap spitting operation with the printheads 150, 155 between passes of a single sheet of print media past the printheads 150, 155.

Figure 2:
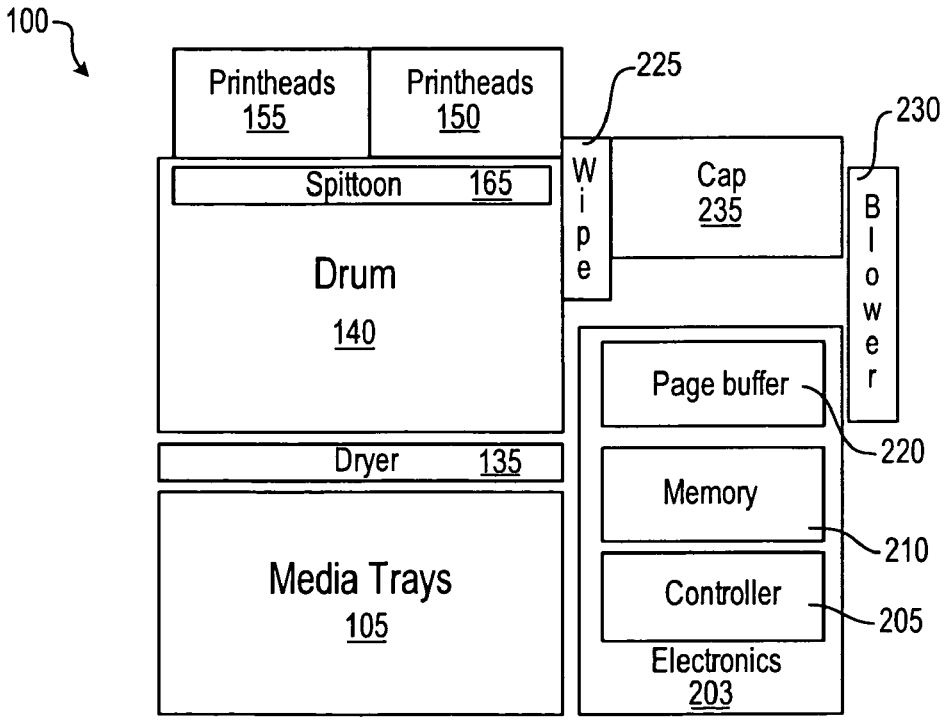
FIG. 2 is a block diagram of a printing system, according to an embodiment of the present disclosure.

FIG. 2 is a side view, block diagram that schematically illustrates the drum-based inkjet printing system 100 of FIG. 1, according to one embodiment of the present disclosure. As illustrated in FIG. 2, the printing system 100 further includes a blower 230. The blower 230 blows air from inside the drum 140 to create the vacuum that helps hold sheets of print media to the exterior of the drum 140.

In some embodiments, the printheads 150, 155 also include a wipe 225 that mechanically wipes the exterior of the printheads 150, 155 to remove excess or drooling ink that may have collected on the exterior of the printheads 150, 155. In some embodiments, during periods of inactivity the printheads 150, 155 also utilize a cap 235 that caps the nozzles of the printheads 150, 155 to prevent ink drooling and to maintain desired environmental conditions, such as sufficient humidity, inside the printhead nozzles.

Additionally, the printing system 100 includes electronics 203 to receive and process document data and convert that data into a format used by the printheads 150, 155. The electronics 203 include a controller 205 and a memory 210. The memory 210 stores document data that has been received from a host computer or other printer client. The data stored in memory 210 includes individual page data, the pages having an original sequence. Data corresponding to individual pages is received into a page buffer 220 that holds the data for a set number of pages.

In some embodiments, the controller or controller circuitry 205 includes application specific integrated circuits ASICs, microcontrollers, or other processing elements. Examples of functions that are performed by the controller circuitry 205 include, but are not limited to, processing and converting data as it is received into the memory 210 of the printing system 100, maintaining the page buffer 220, determining an amount of time on the drum 140 required by each page in the buffer 220 to print, determining an optimal page order for the buffer 220, controlling printhead 150, 155 operation, controlling drum rotation, controlling dryer and media tray operation, performing user interface operations, and other functions.

While the embodiments associated with FIGS. 1-2 illustrate a print drum 140, it will be understood that in some embodiments, other types of print supports (those that include a generally flat portion and/or which may be non-rotational) configured to support a media during printing can be substituted in place of a print drum 140. It will be understood by those skilled in the art that appropriate modifications would account for the different shapes of the alternate printing supports. In this regard, other types and/or shapes of print supports usable with mobile printheads 150, 155 will be familiar to those skilled in the art.

Figure 3:
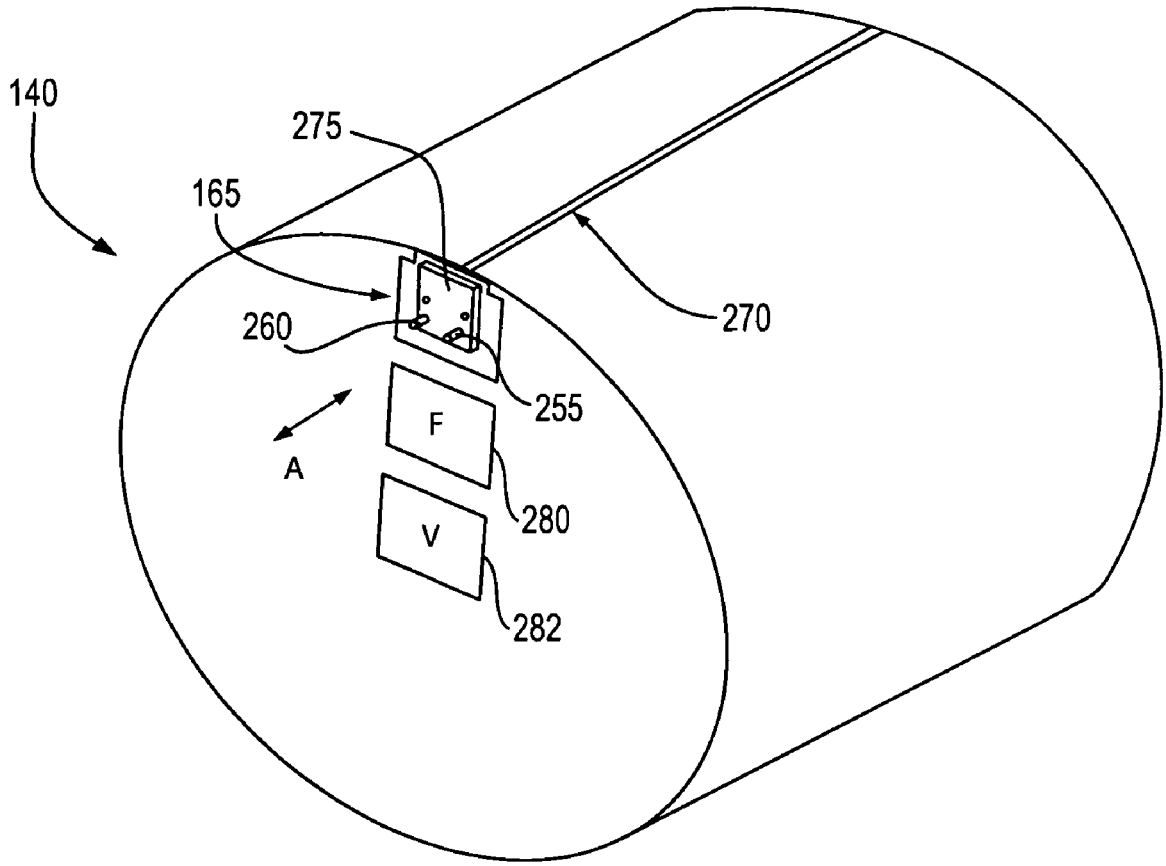
FIG. 3 is a perspective view of a printing drum, according to an embodiment of the present disclosure.

FIG. 3 is a perspective view of a print drum 140, according to one embodiment of the present disclosure. The exemplary print drum 140 is configured to rotate as one or more pages of print media are adhered to the outer periphery of the drum 140 via the previously described partial vacuum applied at the surface of the drum. As the drum 140 rotates, the pages of print media are cycled through various phases of a printing process.

In one aspect, the print drum 140 includes a replaceable printhead spittoon 165 disposed within a longitudinal slot 270 in the drum 140. In one embodiment, the spittoon 165 is slidably, removably installed within the slot 270 along a direction generally parallel to slot 270 (as represented by directional arrow A). The printhead spittoon 165 is configured to receive liquid ink from the printheads 150, 155 via decap spitting operations. In general terms, to accomplish this task, the spittoon 165 presents an exposed portion of a rolled sheet or web of absorbent material (when the spittoon 165 is loaded into the drum 140) that is in alignment with and recessed relative to the printheads 150, 155 for spitting through the open slot 270 of drum 140 onto the exposed portion. Particular details of this spittoon 165 are described later in more detail in association with FIGS. 4-6.

By equipping the print drum 140 with a spittoon 165 that is disposed in the drum 140, print operations need not be significantly interrupted to move the printheads to a spittoon away from the drum when a spitting operation is needed to maintain printhead health. Furthermore, in many embodiments, lateral movement by the printheads is not required during a spitting operation because the slot 270 providing access to the absorbent material (not shown, but illustrated in FIGS. 4-5) in the spittoon 165 substantially extends from one end or circular face of the drum 140 to the other, thereby providing access to the absorbent material through slot 270 all along the range of lateral movement of printheads over the drum 140.

In some embodiments, as illustrated in FIG. 3, the spittoon 165 also includes an interface plate 275 having first and second knobs 255, 260. The interface plate 275 provides control of rollers within the spittoon used to manipulate the roll of absorbent material (not shown). By turning one or both of the first and second knobs 255, 260, absorbent material is advanced from one roller to another, thus exposing a new, clean portion of absorbent material (via slot 270) when a previous portion has become saturated with ink during spitting operations. In some embodiments, a printing system is equipped to automatically, periodically advance the absorbent material based on the passage of time, indications from sensors, printhead usage, or the like.

When the spittoon 165 has used up its entire length of absorbent material for decap spitting operations of the printheads, the spittoon 165 is replenished. In one embodiment, this replenishment is accomplished by removing the used spittoon 165 from the longitudinal slot 270 and sliding a new spittoon into the longitudinal slot 270 of the drum 140. Alternatively, in some other embodiments, the spittoon 165 is replenished via removing the spittoon, exchanging the spent roll of absorbent material in the spittoon 165 for a new roll of absorbent material, and then re-installing the re-loaded spittoon 165 in the drum 140.

In some embodiments, a printing system detects and notifies a user that the spittoon 165 requires maintenance, for example, when the roll of absorbent material has been entirely advanced from a first roller to second roller within the spittoon. In one aspect, the printing system performs this detection via measuring a mechanical resistance or tension that occurs during rotation of one or both of the knobs 255, 260, comparing a measured amount of rotation of one or both of the knobs 255, 260 to a given value, sensors, or by other means.

In addition, in some embodiments, the spittoon 165 includes a filter 280 disposed vertically below the absorbent portion of the spittoon 165 while in some embodiments, a vacuum source 282 is located vertically below the filter 280. As will be later described in more detail in association with FIGS. 4-6, the vacuum source applies a vacuum to the spittoon 165 to pull ink-laden aerosol (produced as the ink is ejected by the printheads 150, 155 of FIGS. 1-2) through and into filter 280. In some embodiments, the filter 280 is replaceable and is replenished when it becomes occluded with captured ink drops.

As previously mentioned, it will be understood that in some embodiments, the print drum 140 can be replaced by a generally flat and/or non-rotating print support with the slot 270 being defined in a surface of the print support over which the printheads 150, 155 travel. In this regard, the spittoon 165 is deployable in non-drum based print supports.

Figure 4:
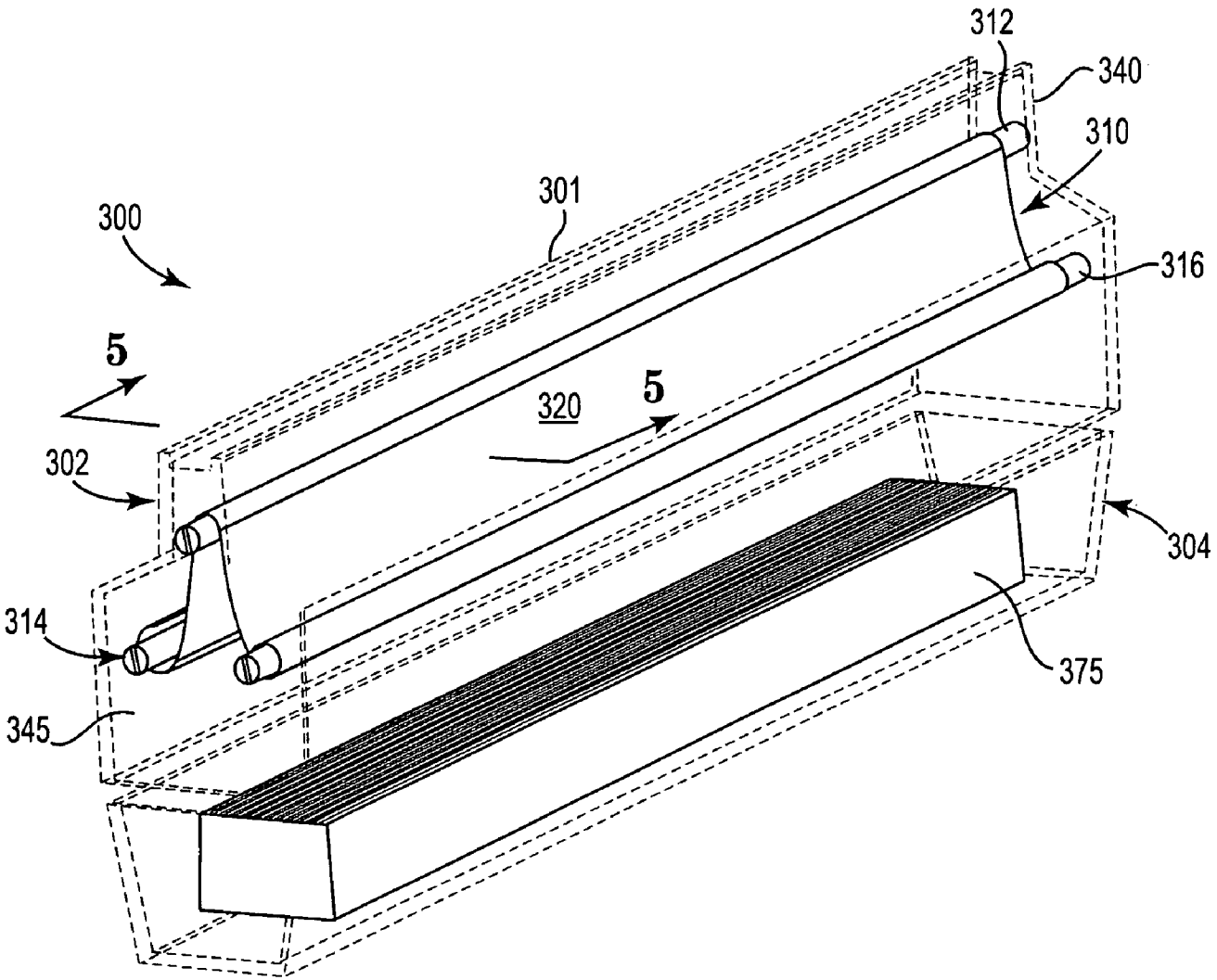
FIG. 4 is a perspective view schematically illustrating a replaceable printer spittoon, according to an embodiment of the present disclosure.
Figure 5:
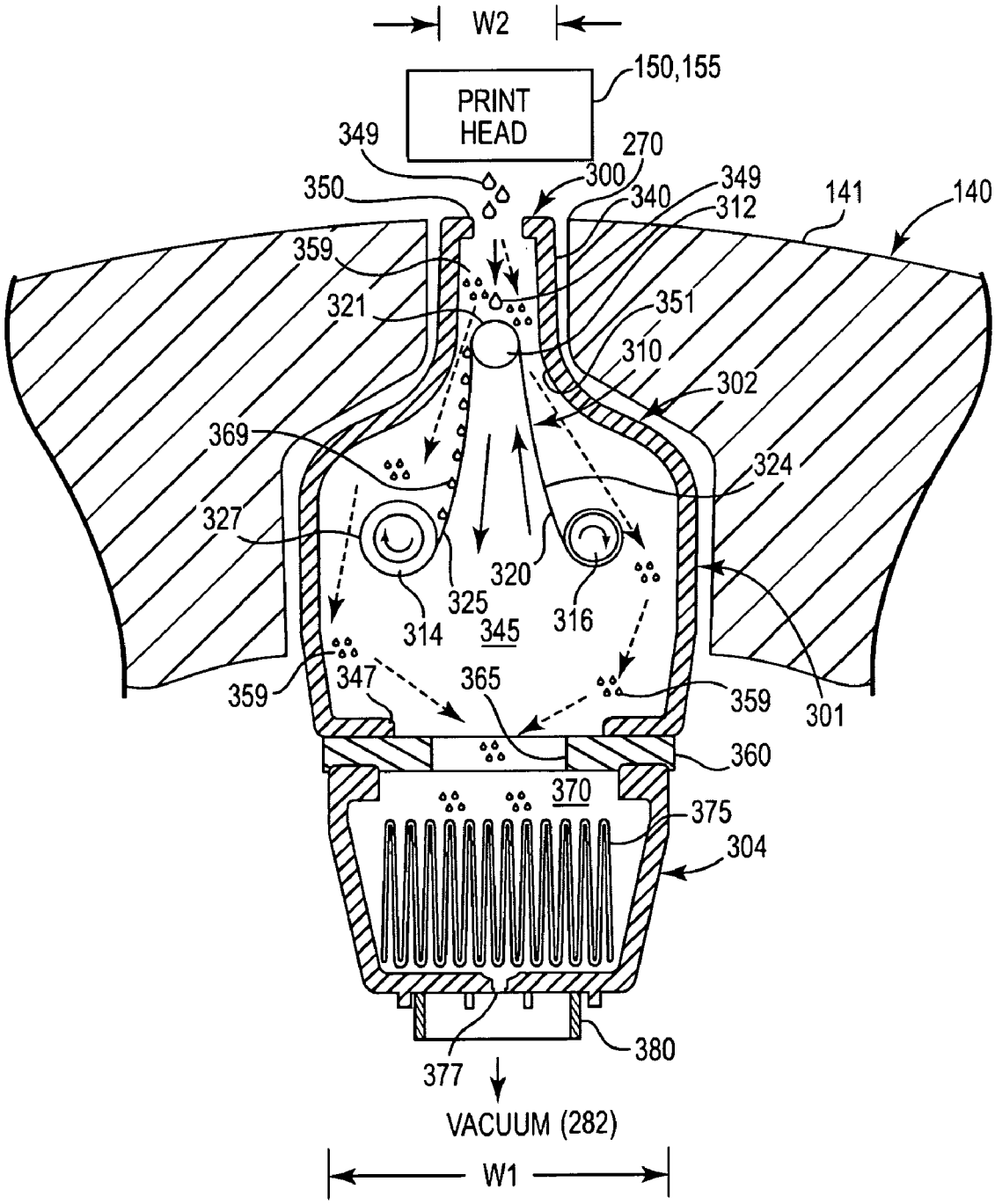
FIG. 5 is a sectional view as taken along lines 5-5 of FIG. 4, according to an embodiment of the present disclosure.
Figure 6:
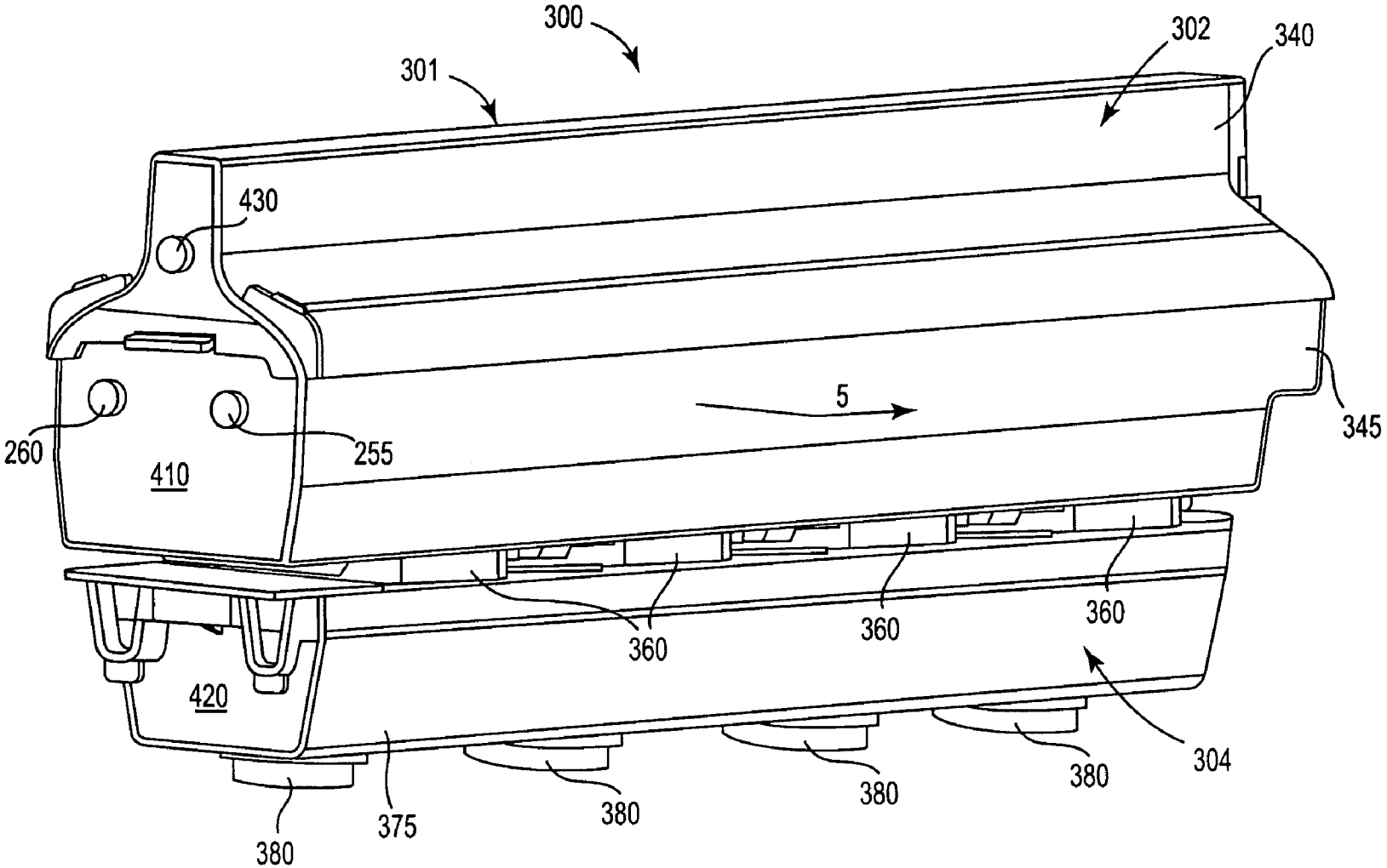
FIG. 6 is a perspective view of a printing spittoon, according to an embodiment of the present disclosure.

FIGS. 4-6 schematically illustrate a replaceable printhead spittoon assembly 300, according to one embodiment of the present disclosure. In one embodiment, the printhead spittoon assembly 300 includes at least substantially the same features and attributes as the spittoon 165, as previously described in association with FIGS. 1-3.

FIG. 4 is a perspective view of a spittoon assembly 300 (with a shell or frame 301 of the spittoon assembly 300 shown in phantom) to schematically illustrate an absorbent sheet assembly 302 and a filter 375 of the spittoon assembly 300, according to one embodiment of the present disclosure. FIG. 5 is a sectional view as taken along lines 5-5 of FIGS. 4 and 6 of the spittoon assembly 300 as mounted in drum 140, according to one embodiment of the present disclosure. FIG. 6 is a perspective view of an outer surface of the spittoon assembly 300, according to one embodiment of the present disclosure.

As illustrated in FIGS. 4 and 6, spittoon assembly 300 comprises a shell or frame 301 that includes an upper portion 302 and a lower portion 304. As illustrated in FIG. 4, the upper portion 302 houses an absorbent sheet assembly 310 within a chimney 340 and a chamber 345 while the lower portion 304 houses a filter 375. In one embodiment, the chimney forms a hollow shaft or passageway to allow passage of ink drops ejected from printheads 150, 155. The sheet assembly 310 includes a mandrel 312 and an array of rollers 314, 316 that support a sheet 320 or web of absorbent material. In one embodiment, the mandrel 312 comprises a non-rotating cylinder or stationary rod. In some embodiments, the sheet 320 of absorbent material comprises a natural or synthetic fabric capable of being stored and advanced by a system of rollers. In one embodiment, the absorbent material is an absorbent web fabric.

As illustrated in FIG. 5, the chimney 340 of the upper portion 320 includes a first opening 350 and a second opening 351. In one aspect, the chimney 340 defines a spit zone through which ink spit by the printheads 150, 155 (and any dislodged ink stalagmites) travels before contacting the absorbent sheet 320. In particular, the spit ink enters chimney 340 through first opening 350 (at a surface 141 of print drum 140) and exits chimney 240 into first chamber 245 via second opening 351. Accordingly, in one aspect, the chamber 345 is located interior to, and is in communication with, the chimney 340 via the second opening 351. The entire sheet assembly 310 is enclosed within the upper portion 302 of shell 301 such that the first roller 316 and the third roller 314 are located within the chamber 345 and such that the mandrel 312 is located within the chimney 340. In one embodiment, the mandrel 312 is located closer to second opening 351 than first opening 350. The first roller 316 comprises a supply roller that provides a fresh supply of the absorbent sheet 320. The absorbent sheet 320 extends upward from first roller 316 in chamber 345 into chimney 340 where it extends over mandrel 312 before descending back into chamber 345 to be collected or taken-up by third roller 314, which acts as a collection roller.

In one aspect, as ink drops 349 are ejected or spit from printhead 150, 155 in a periodic cleaning or decap spitting operation, the ink drops 349 descend directly from the printheads 150, 155 through chimney 340 and toward target portion 321 on first side 324 of sheet 320 exposed on mandrel 312. However, at the same time, some ink-laden aerosol 359 (associated with the spit or ejected ink drops 349) does not contact the target portion 321 and instead passes by the target portion 321 into chamber 345. Capture of this aerosol is described below.

In one aspect, the mandrel 312 is located at a position that is recessed from the first opening 350 of chimney 340, and therefore recessed from the surface 141 of print drum 140. In one embodiment, the mandrel 312 is recessed by a distance sufficient to ensure that the ink droplet 349 being fired during decap spitting from the printheads 150, 155 has sufficient integrity to remain as a drop as it travels down chimney 340 without spattering into the print zone at the surface 141 of the drum 140. In addition, the mandrel 312 is recessed from first opening 350 by a distance sufficient to prevent migration of any residual buildup on the absorbent sheet 320 onto the printheads 150, 155 or media.

In another aspect, although FIG. 5 depicts a generally curved surface 141 of drum 140, it will be understood that in some embodiments (as previously described) the spittoon assembly 300 is deployable in a slot 270 of generally flat or non-drum based print support (instead of drum 140) and that, except for this difference, the spittoon assembly 300 will otherwise function substantially the same with regard to printheads 150, 155 as described throughout this present disclosure.

As the absorbent sheet 320 becomes soiled by the liquid ink from printhead spitting, the portion of absorbent material wrapped around the mandrel 312 is periodically advanced toward the third roller 314 as a portion of fresh, clean absorbent material from the first roller 316 is simultaneously advanced to extend over the mandrel 312 and underneath the printheads 150, 155 (although in a recessed location) within chimney 340. This advancement is controlled manually or automatically, as will be described later in more detail.

As illustrated in FIG. 5, some of the ink drops 349 adhere to the first side 324 of the absorbent sheet 320 (represented by drops 369). In one embodiment, third roller 314 is configured and oriented to collect the used portions of sheet 320 with the first soiled side 324 of the sheet 320 facing and in contact with an outermost used sheet 327 on roller 314. In this arrangement, the outermost used sheet 327 (wound on roller 314) exposes a relatively clean side 325 of the sheet 320 such that, as the sheet 320 is wound onto roller 314, the first soiled side 324 of the used sheet 320 is brought into contact against this relatively clean, outermost wound sheet 327. As each successive used portion of the sheet 320 is wound (under tension) on an underlying used portion of sheet 320 on the roller 314, the soiled ink residue (stalagmites) on first side 324 of sheet 320 becomes sandwiched and compressed between previously wound portions of the sheet 320. Via this compression and with the soiled side 324 facing inward, the roller 314 effectively encapsulates the waste ink material within the already wound portions on the roller 314.

It will be understood that, under pressure from vacuum 282, as the ink-laden aerosol 359 travels through chimney 340 and through chamber 340 (as further described below), this aerosol could incidentally contact one or both sides 324, 325 of the absorbent sheet 320 extending between the respective rollers 314, 316 and over the mandrel 312. However, this incidental contact does not substantially compromise the ability of the absorbent sheet 320 to capture and absorb ink drops 349 ejected by printheads 150, 155 through chimney 340 and onto first side 324 of sheet 320 at the target zone 321 within the second opening 351 of chimney 340.

This arrangement is in sharp contrast to conventional arrangements in which a soiled side of an absorbent material would face outwardly as wound on the collection roller such that the outwardly facing material would continually include a portion of the collection roller that exposes the soiled ink material. In this way, these conventional arrangements fail to encapsulate or sealingly contain the soiled ink material within the layers of the collection roller 314.

In some embodiments, once ejected from printheads 150, 155, the ink drops 349 (and/or aerosol 359) is pulled through chimney 340 and into chamber 345 by the negative pressure applied via vacuum 282. In one aspect, this vacuum ensures that ink drops 349 and aerosol 359 enter chimney 340 (instead of lingering at an outer surface of drum 140). However, in another aspect, the vacuum 282 pulls the aerosol 359 beyond chamber 345 to enter chamber 370 of lower portion 304 where these ink-laden aerosol 359 is captured via filter 375.

Accordingly, via this arrangement, the presence of the ink-laden aerosol 359 (those not captured via absorbent sheet 320) is effectively eliminated, thereby preventing migration of this aerosol 359 within or outside of printing drum 140. At periodic intervals, once the filter 375 becomes full from capturing aerosol 359 (and/or any other ink residue), the filter 375 is replaced with a new filter 375. In some embodiments, the filter 375 is replaced simultaneously with replacement of the absorbent sheet assembly 310 (or of absorbent sheet 320). In other embodiments, the filter 375 is replaced on a schedule separate from a schedule or interval of replacing the absorbent sheet assembly 310 (or of absorbent sheet 320)

In one embodiment, the chamber 345 has a width (W1) that is substantially greater (e.g., 2 to 3 times greater) than a width (W2) of the chimney 340. In this arrangement, the chamber 345 provides adequate space for the rollers 314, 316 of the sheet assembly 310 while the relatively thinner chimney 340 maintains a low profile within recess 142 of at the outer surface 141 of drum 140. In addition, the relatively thinner chimney 340 helps to channel the ink drops 349 and/or aerosol 359, under vacuum pressure, down into the chamber 345.

In one aspect, a proximal opening 347 in a bottom of chamber 345 of upper portion 304 is in fluid communication, via hole 365 in gasket 360, with chamber 370 of lower chamber 304 while gasket 360 maintains a sealed connection between the respective chambers 345 and 370. The previously described vacuum 282 is applied via port 380 located at a proximal opening 377 of the chamber 370 of lower portion 304.

Accordingly, via this arrangement, spittoon assembly 300 provides an environmentally friendly mechanism to capture used or soiled ink from decap spitting operations by capturing the ink drops onto sheet 320 within successively wound used portions of sheet 320 on the collection roller 314. At the same time, the spittoon assembly provides an environmentally friendly way to capture ink-laden aerosol produced during these spitting operations by capturing the aerosol within filter 375 through the assistance of the vacuum 282. Accordingly, a used spittoon assembly 300 (built and used according to the principles of the present disclosure) will permit handling the spittoon assembly 300 with less stringent transportation standards as otherwise would be applicable to conventional spittoons that do not sufficiently contain the used ink drops and/or aerosol produced via decap spitting operations.

As illustrated in FIG. 6, the upper portion 302 and lower portion 304 of frame 301 of the spittoon assembly 300 further includes end piece 410 and end piece 420, respectively. As previously described, in some embodiments, the sheet 320 is periodically advanced via manual manipulation of one or both of the knobs 255, 260 accessible via end piece 410 such that the absorbent sheet 320 is advanced from one roller to another, thus exposing a clean portion of the absorbent material 320 on mandrel 312 within chimney 340.

In other embodiments, the absorbent sheet 320 is periodically advanced automatically via an internal or external drive system used to turn the knobs 255, 260 that control the rotational position of the respective rollers 314, 316. In one embodiment, an internal drive system is part of the spittoon assembly 300 and drum 140, which allows the advancement of the absorbent sheet 320 at any time. In another embodiment, with an external drive system, the drum 140 is rotated to a particular position where the external driving system can engage the spittoon and advance the absorbent sheet 320. In either case, in some embodiments, the internal or external drive systems include motorized devices to turn the knobs 255, 260 to indirectly turn rollers 314, 316 or to directly control rollers 314, 316 while bypassing knobs 255, 260. In yet another embodiment, a passive system is used advance the absorbent sheet 320, such as via an indexing mechanism that is actuated by rotation of the print drum 140, which therefore automatically causes rotation of the rollers 314, 316.

Figure 7:
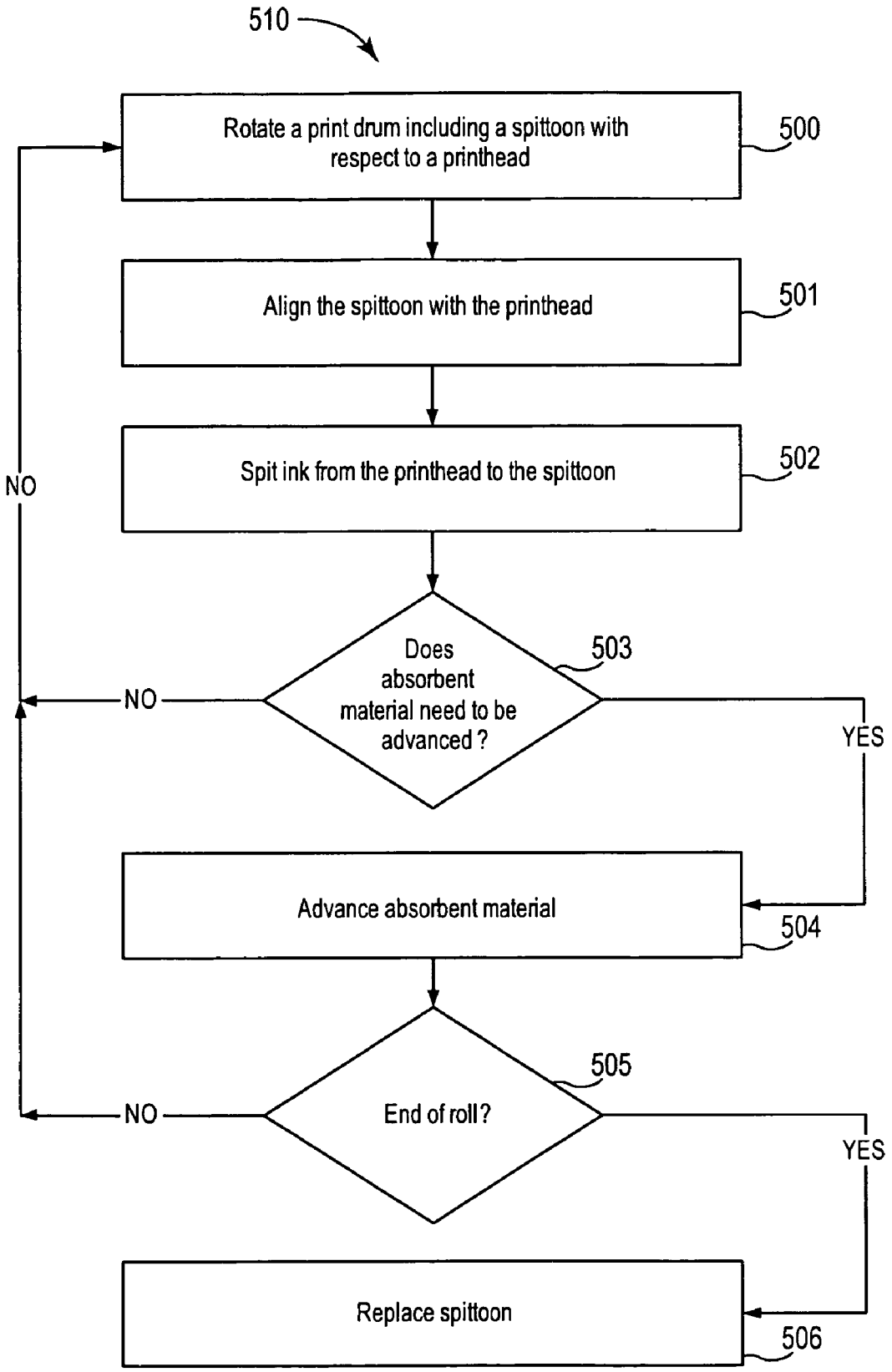
FIG. 7 is a flow diagram schematically illustrating a method of operating a printing system with a spittoon, according to an embodiment of the present disclosure.

FIG. 7 is a flow diagram schematically illustrating a method 510 of operating a printing system and spittoon assembly, according to one embodiment of the present disclosure. In one embodiment, the method 510 is performed using the assemblies, systems, and components of a printing system that includes spittoon assembly 300, as previously described in association with FIGS. 1-6. However, in other embodiments, method 510 is performed using other printing systems and/or other spittoon assemblies.

As illustrated in FIG. 7, the print drum (which includes a spittoon assembly such as that described above), is rotated with respect to a printhead, as shown at 500. As the drum rotates, printing operations can be conducted.

When it is determined that a decap spitting operation should be performed to clean the nozzles or jets of the printhead, the drum is rotated so as to align the spittoon with the printhead as shown at 501. Ink is then spit from the printhead as needed step 502.

As described above, the spittoon includes a sheet or other configuration of absorbent material that can be advanced to provide clean material for additional spitting operations. Additionally, method 510 includes determining whether the absorbent material should be advanced to provide a clean portion of the absorbent material below (and recessed from) the printheads, as shown at 503. As indicated above, in one embodiment, this determination can be made by the controller of the printing system based on how much ink has been expelled in decap spitting operations since the absorbent material was last advanced. Accordingly, the controller can then make a determination as to whether the absorbent material should be advanced again, as shown at 504.

In some embodiments, method 510 also determines when no more absorbent material remains to be advanced into position for decap spitting operations, as shown at 505. As explained above, this determination can be made by sensing the tension on the rollers bearing the absorbent material in the spittoon. Alternatively, the system controller simply tracks how many times the absorbent material has been advanced and compares that tracked quantity with a known amount of absorbent material in the spittoon and the amount consumed by each advancement of the absorbent material. In this way, the controller can sense or determine when the clean absorbent material is exhausted.

When no more absorbent material remains to be used determination 505, the spittoon can be replaced, as shown at 506. As noted above, this replacement involves replacing the entire spittoon or merely replacing the supply of absorbent material within the spittoon.

Embodiments of the present disclosure provide a spittoon assembly configured to capture ink drops, ink residue, and/or aerosol produced via printhead spitting operations. In one aspect, the spittoon assembly captures these unwanted materials onto an absorbent sheet provided at a recessed location relative to a drum surface to ensure that the spit materials do not interfere with future printing. In another aspect, the absorbent sheet is provided an array of rollers configured to continually encapsulate the unwanted ink material as the sheet is used up. This arrangement ensures environmentally friendly transport of a spent spittoon assembly. In another aspect, other ink residue and/or aerosol is captured via a combination of a vacuum and filter, further ensuring encapsulation of unwanted ink material and environmentally friendly transport of the spittoon assembly.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A spittoon assembly for receiving drops from a printhead, the spittoon assembly comprising:

a spittoon removably, slidably mountable in a slot of a print support and including:

a chimney that includes a first opening positioned to be exposed at a surface of the print support and a second opening spaced apart from the first opening, wherein the chimney is independent of and separate from the slot of the print support; and a sheet assembly at least partially contained within the chimney and configured to support and expose, within the chimney at a location recessed relative to the first opening and between the respective first and second openings, a target portion of a first side of an absorbent sheet to receive the drops through the chimney, wherein the recessed location of the target portion is closer to the second opening than the first opening of the chimney.

2. The spittoon assembly of claim 1, wherein the sheet assembly comprises a mandrel positioned in the chimney at the recessed location and configured to support the target portion of the first side of the absorbent sheet in the recessed, exposed location.

3. The spittoon assembly of claim 2, wherein the spittoon assembly comprises a first chamber in communication with the chimney via the second opening, and wherein the sheet assembly comprises both a feed roller and a take-up roller positioned within the first chamber, the feed roller configured to supply a clean portion of the absorbent sheet to the mandrel and the take-up roller configured to receive a used portion of the absorbent sheet from the mandrel, with the mandrel interposed between the feed roller and the take-up roller, such that the absorbent sheet extends from the feed roller, over the mandrel, and to the take-up roller.

4. The spittoon assembly of claim 3, wherein the first chamber has a width substantially greater than a width of the chimney.

5. The spittoon assembly of claim 3, wherein the take-up roller is configured to collect the used portion of the absorbent sheet in an orientation in which the exposed first side is wound to face, and to be in contact against, a second side of the absorbent sheet outermost on the take-up roller.

6. The spittoon assembly of claim 3, wherein the first chamber includes a third opening and the spittoon assembly further comprises:

a second chamber in communication with the first chamber via the third opening; and a filter housed within the second chamber.

7. The spittoon assembly of claim 6, wherein the second chamber, includes a fourth opening and the spittoon assembly further comprises:

a vacuum port in communication with the fourth opening of the second chamber and configured to apply a vacuum to pull aerosol from the surface of the print support and from the chimney, through the first chamber, and into the filter of the second chamber.

8. The spittoon assembly of claim 1, wherein the print support comprises a print drum configured to selectively support a media and to rotate to present the media to the printhead, wherein the printhead is configured to eject ink onto the media supported via the print drum.

9. A spittoon assembly for receiving drops from a printhead, the spittoon assembly comprising:

a spittoon removably mountable in a slot of a print support and including:

a chimney that includes a first opening positioned to be exposed at a surface of the print support and a second opening spaced apart from the first opening;

a sheet assembly configured to support and expose, within the chimney at a location recessed relative to the first opening, a first side of an absorbent sheet to receive the drops through the chimney;

a first chamber disposed vertically below, and in communication with, the chimney via the second opening, wherein the first chamber includes a third opening;

a second chamber disposed vertically below the first chamber and in communication with the first chamber via the third opening, the second chamber including a vacuum port connectable to a vacuum source; and a filter housed within the second chamber.

10. A spittoon assembly for receiving drops from a printhead, the spittoon assembly comprising:

a spittoon removably mountable in a slot of a print support and including:

a shell that includes a first portion having a first opening positioned to be exposed at a surface of the print support and a second opening spaced apart from the first opening, wherein the shell is independent of and separate from the slot of the print support; and a sheet assembly contained within the shell and configured to support and expose, within the first portion of the shell at a location recessed relative to the first opening, a target portion on a first side of an absorbent sheet to receive the drops, wherein the recessed location of the target portion is closer to the second opening than the first opening of the first portion of the shell, and wherein the sheet assembly includes:

a take-up roller positioned within the shell and configured to receive a used portion of the absorbent sheet, wherein the take-up roller is configured to collect the used portion of the absorbent sheet in an orientation in which the exposed first side is wound to face, and to be in contact against, a second side of the absorbent sheet outermost on the take-up roller.

11. The spittoon assembly of claim 10, wherein the first portion of the shell comprises a chimney and wherein the sheet assembly comprises:

a mandrel located in the chimney to support the target portion of the absorbent sheet at the recessed location and vertically above the take-up roller, wherein the take-up roller is at a position external to and vertically below the chimney; and a feed roller positioned within the shell below the chimney and configured to supply a clean portion of the absorbent sheet to the mandrel, wherein the mandrel is interposed between the feed roller and the take-up roller, such that the absorbent sheet extends from the feed roller, over the mandrel, and to the take-up roller.

12. The spittoon assembly of claim 11, wherein the shell comprises:

a first chamber disposed vertically below, and in communication with, the chimney via the second opening, wherein the first chamber houses the feed roller and the take-up roller wherein the first chamber includes a third opening; and a second chamber disposed vertically below the first chamber and in communication with the first chamber via the third opening, the second chamber housing a filter and defining a vacuum port vertically below the filter, wherein the vacuum port is configured to communicate with a vacuum source.

* * * * *

UNITED STATES PATENT AND TRADEMARK OFFICE

CERTIFICATE OF CORRECTION

PATENT NO. : 8,272,714 B2
APPLICATION NO. : 12/436670
DATED : September 25, 2012
INVENTOR(S) : Jeffrey R. Blackman et al.

It is certified that error appears in the above-identified patent and that said Letters Patent is hereby corrected as shown below:

In column 11, line 18, in Claim 7, delete "chamber," and insert -- chamber --, therefor.

Signed and Sealed this
Nineteenth Day of February, 2013

Teresa Stanek Rea
*Acting Director of the United States Patent and Trademark Office*